US008225535B2

(12) United States Patent
Dillenbeck

(10) Patent No.: US 8,225,535 B2
(45) Date of Patent: Jul. 24, 2012

(54) FOOTWEAR INCLUDING A FOLDABLE HEEL

(75) Inventor: Ryan Dillenbeck, Santa Barbara, CA (US)

(73) Assignee: Deckers Outdoor Corporation, Goleta, CA (US)

( * ) Notice: Subject to any disclaimer, the term of this patent is extended or adjusted under 35 U.S.C. 154(b) by 333 days.

(21) Appl. No.: 12/776,477

(22) Filed: May 10, 2010

(65) Prior Publication Data

US 2011/0271556 A1 Nov. 10, 2011

(51) Int. Cl.
*A43B 3/24* (2006.01)

(52) U.S. Cl. ..... 36/100; 36/105; 36/68

(58) Field of Classification Search ..... 36/68, 69, 36/100, 105, 106, 138, 51
See application file for complete search history.

(56) References Cited

U.S. PATENT DOCUMENTS

| | | | | |
|---|---|---|---|---|
| 4,497 | A | 5/1846 | Vetter | |
| 117,897 | A | 8/1871 | Letson | |
| 1,084,197 | A | 1/1914 | Collis | |
| 1,465,343 | A | 8/1923 | Case | |
| 1,533,287 | A | 4/1925 | Williams | |
| 1,568,698 | A | 6/1926 | Posner | |
| 1,769,328 | A | 7/1930 | Auster | |
| 2,311,996 | A | 2/1943 | Parker | |
| 2,634,515 | A | 4/1953 | Saitta | |
| 2,720,042 | A | 10/1955 | Marcy | |
| 2,734,286 | A | 2/1956 | Anson | |
| 3,146,535 | A * | 9/1964 | Owings | 36/7.3 |
| 3,192,651 | A | 7/1965 | Smith | |
| 4,299,039 | A | 11/1981 | Hanson | |
| 4,559,722 | A * | 12/1985 | Norton | 36/89 |
| 4,662,088 | A * | 5/1987 | Autry et al. | 36/105 |
| 4,783,909 | A | 11/1988 | Van Doren et al. | |
| 4,910,885 | A | 3/1990 | Hsieh | |
| 5,012,596 | A | 5/1991 | Schiller | |
| 5,054,216 | A | 10/1991 | Lin | |
| 5,109,614 | A | 5/1992 | Curry | |
| 5,127,170 | A | 7/1992 | Messina | |
| 5,282,327 | A | 2/1994 | Ogle | |
| 5,787,608 | A | 8/1998 | Greenawalt | |
| 6,115,943 | A | 9/2000 | Gyr | |
| 6,205,680 | B1 | 3/2001 | Clark | |
| 6,367,171 | B1 | 4/2002 | Burt | |
| D467,063 | S | 12/2002 | Chen | |
| 6,594,921 | B2 * | 7/2003 | Laio et al. | 36/138 |
| 6,782,641 | B2 | 8/2004 | Turner et al. | |
| 6,938,361 | B2 | 9/2005 | Su | |

(Continued)

FOREIGN PATENT DOCUMENTS

DE 4243490 A1 6/1994

(Continued)

*Primary Examiner* — Marie Patterson
(74) *Attorney, Agent, or Firm* — Greer Burns & Crain Ltd.

(57) ABSTRACT

An article of footwear including an outsole, an upper attached to the outsole and a heel portion attached to the outsole and movably connected to the upper. The heel portion is movable between a support position, where the heel portion is substantially transverse to the outsole, and a mule position, where the heel portion is substantially parallel to the outsole. A cushioning heel pad is attached to an outer surface of the heel portion, where the heel pad has a designated thickness and contacts and supports a user's heel when the heel portion is in the mule position.

17 Claims, 6 Drawing Sheets

U.S. PATENT DOCUMENTS

| | | | | |
|---|---|---|---|---|
| 7,055,264 | B2 | 6/2006 | Gallegos | |
| 7,100,308 | B2 | 9/2006 | Aveni | |
| 7,152,341 | B2 | 12/2006 | Dean | |
| 7,168,188 | B2 | 1/2007 | Auger | |
| 7,331,122 | B2 | 2/2008 | Januszewski et al. | |
| 7,360,326 | B1 | 4/2008 | Tanaka | |
| 7,565,755 | B2 | 7/2009 | Tvoua et al. | |
| D654,679 | S * | 2/2012 | Dean | D2/969 |
| 2002/0095823 | A1 * | 7/2002 | Laio et al. | 36/138 |
| 2005/0108897 | A1 | 5/2005 | Aveni | |
| 2006/0010718 | A1 | 1/2006 | Auger et al. | |
| 2006/0075656 | A1 | 4/2006 | Januszewski et al. | |
| 2007/0074425 | A1 | 4/2007 | Leong | |
| 2007/0289167 | A1 | 12/2007 | Pieriboni | |
| 2008/0189984 | A1 | 8/2008 | Januszewski et al. | |
| 2009/0307929 | A1 | 12/2009 | Tvoua et al. | |
| 2011/0016751 | A1 * | 1/2011 | Somerville | 36/105 |

FOREIGN PATENT DOCUMENTS

| | | |
|---|---|---|
| DE | 19611797 | 10/1997 |
| FR | 2761239 A1 | 10/1998 |

* cited by examiner

FOOTWEAR INCLUDING A FOLDABLE HEEL

BACKGROUND OF THE INVENTION

A mule is a type of shoe that typically has a closed toe and is backless or has no strap around the heel. These types of shoes are designed for a foot to easily slide into or out of the shoe. Such shoes are desirable because the slip-on style is convenient as it takes a short time to put the shoes on with no buckles or shoelaces to tie, and mules can be worn with any style of dress from casual to formal.

Mule-type shoes, however, are not typically worn for activities, such as sports, that involve running, jumping, climbing and quick starting and stopping motions. One reason is that mule-type shoes are not convenient or useful for such activities because the shoes can easily fall off of a person's foot or feet during these activities. Thus, most athletic shoes used for sports, running and other similar activities have a closed heel to securely hold the shoes on a person's feet. Many people that wear mule-type shoes, therefore, typically have to carry a pair of closed heel shoes with them to change into if they are going to be doing athletic activities such as sports. Needing an extra pair of shoes for such activities can be burdensome and inconvenient, as well as expensive.

Additionally, many people manually convert regular closed heel shoes into mule-type shoes by forcibly smashing the heel downward against the footbed with their feet. In particular, children will forcibly bend the heel down so that they can easily slip their closed heel shoes on and off their feet without having to spend time tying their shoelaces or securing straps. Forcibly bending the heels down on shoes that are not constructed to be bent down causes the material forming the heels to deteriorate and lose support, ultimately destroying the shoes.

BRIEF SUMMARY

An article of footwear is provided that has a foldable heel portion with a cushioning heel pad that provides comfort and support to a user's heel when the heel portion is moved downward against a footbed to convert the article of footwear to a mule.

In an embodiment, an article of footwear is provided that includes an outsole, an upper attached to the outsole and a heel portion attached to the outsole and movably connected to the upper. The heel portion is movable between a support position, where the heel portion is substantially transverse to the outsole, and a mule position, where the heel portion is substantially parallel to the outsole. A cushioning heel pad is attached to an outer surface of the heel portion, where the heel pad has a designated thickness and contacts and supports a user's heel when the heel portion is in the mule position.

In another embodiment, an article of footwear is provided that includes an outsole, a footbed placed on an upper surface of the outsole and an upper attached to the outsole and enclosing the footbed. The upper defines a foot entry opening and includes a heel portion that is movable between a support position, where the heel portion is substantially transverse to the footbed and supports a back portion of a user's heel, and a mule position, where the heel portion is substantially parallel to the footbed. A pillow-shaped heel pad is attached to an outer surface of the heel portion, where a user's heel contacts and is supported by the heel pad when the user's foot presses against the outer surface of the heel portion and moves the heel portion to the mule position.

DETAILED DESCRIPTION

Referring now to FIGS. 1-6, the present article of footwear includes a foldable heel portion having a cushioning heel pad that provides support and comfort to a user's heel when the heel portion is folded downward to form a mule-type shoe.

Figure 1:
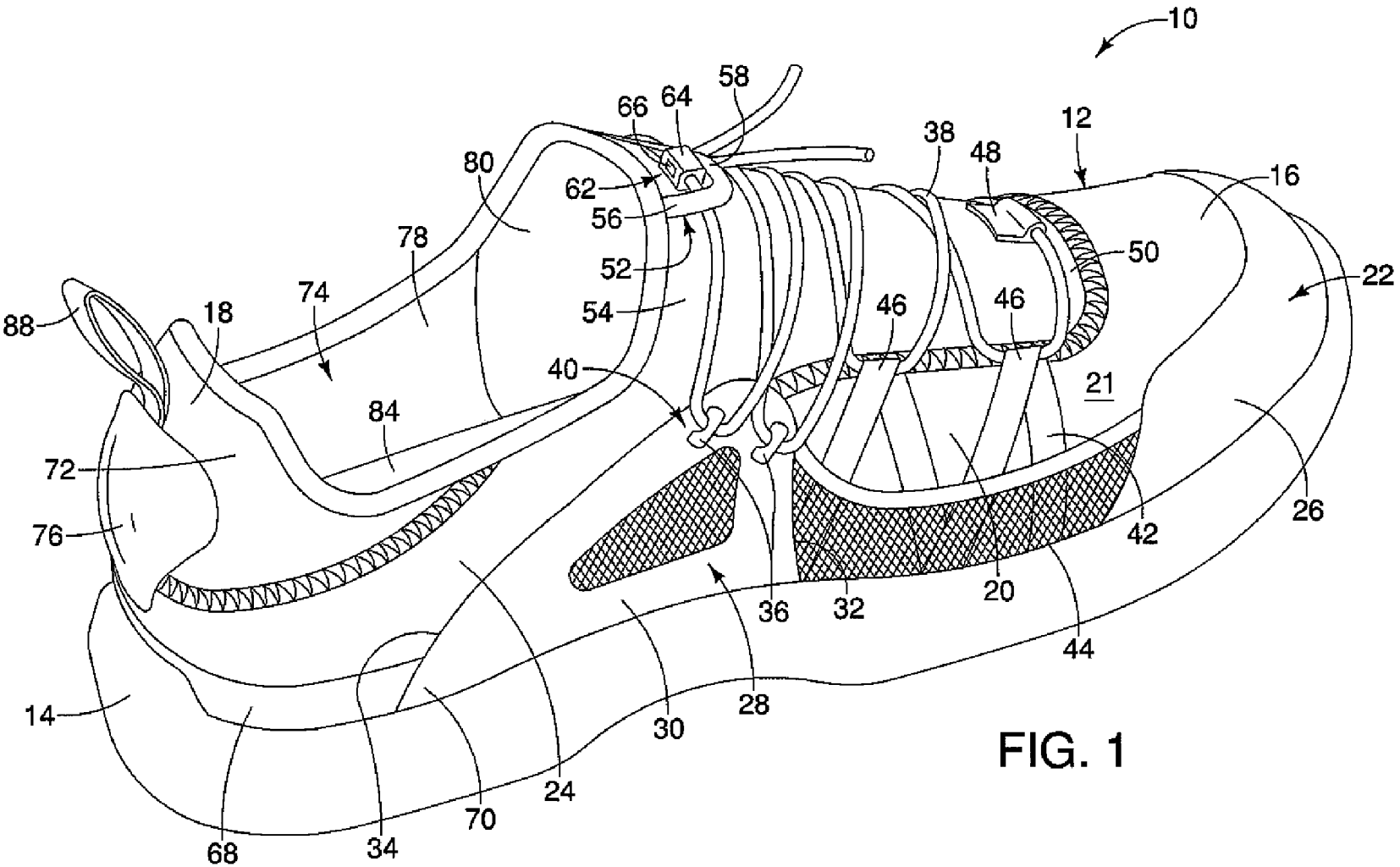
FIG. 1 is a rear perspective view of the present article of footwear having a foldable heel with the heel portion in the support position.
Figure 3:
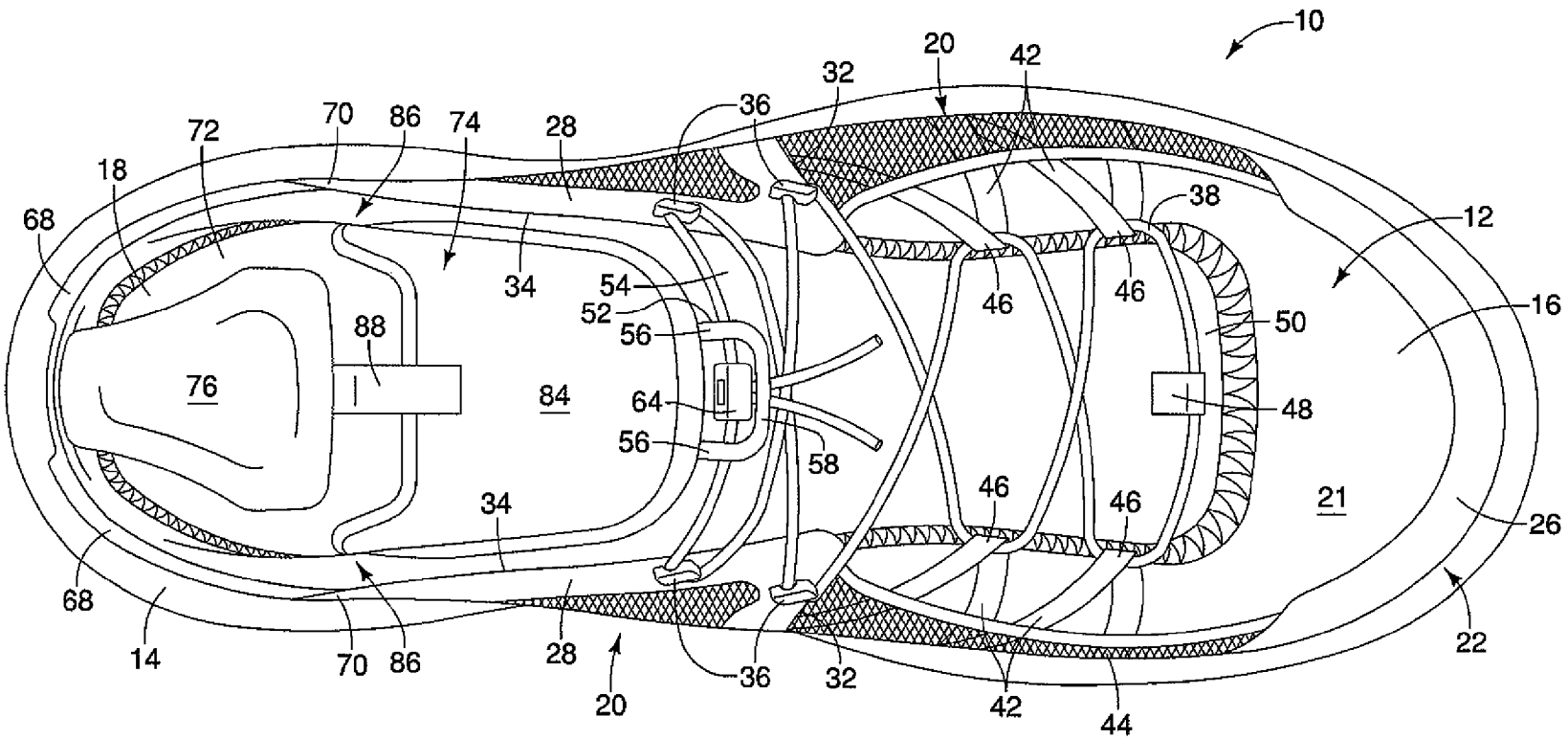
FIG. 3 is a top view of the article of footwear shown in FIG. 1.

The article of footwear or shoe generally designated 10, includes an upper 12 connected to an outsole 14. As shown in FIGS. 1 and 3, the upper 12 includes a front end 16 and a rear end 18 that are connected by opposing sides 20. The sides 20 extend to the rear end or heel portion 18 and are joined together by stitching or any suitable connector or connection method. The front end 16 of the upper 12 is generally made of a non-stretchable material portion 21 that extends from a toe portion 22 and along the sides 20 of the upper. The non-stretchable material portion 21 is preferably a polyester air mesh or sandwich mesh material but may be any suitable material or combination of materials.

The upper 12 also includes a flex portion 24 that is made of a stretchable material extending down a center area of a top surface of the upper and along the sides 20 to the rear end or heel portion 18. The flex portion 24 is connected to the non-stretchable material portion 21 of the upper by cross-stitching. It should be appreciated that other types of stitching and other suitable connection methods may be used to connect the flex portion to the non-stretchable material portion. The stretchable material of the flex portion 24 is preferably a laminated stretchable mesh material such as a Lycra® material but may be any suitable material or combination of materials.

The toe portion 22 of the upper 12 includes a toe cap 26 made of a suitable durable material such as rubber. Two quarter pieces 28 extend from the toe cap 26 and along the sides 20 of the upper 12. Each quarter piece 28 includes a generally triangular member 30 having a front edge 32 and a rear edge 34 where the rear edge slants at a designated rearward angle downwardly to the outsole 14. As shown in FIG. 1, the quarter pieces 28 are made of a combination of a relatively rigid mesh material and a durable material such as rubber, a PU coated synthetic leather or leather. Each quarter piece 28 is attached to the upper 12 by stitching or other suitable connectors or connection methods. At least two eyelets 36 are attached to the triangular portions 30 and are used to secure one or more shoelaces 38 to the shoe. The eyelets 36 are preferably made of a metal such as stainless steel but may be made out of any suitable material. Each eyelet 36 defines an opening 40 for receiving and securing the shoelaces 38 to the upper 12.

Each side 20 of the front end 16 of the upper 12 includes overlapping shoelace straps 42 where ends 44 of the straps are secured to the upper 12 by stitching and form a loop 46 at an inner end. To help secure the shoelaces 38 to the shoe 10, a front shoelace guide 48 is attached to a front end 50 of the flex portion 24 and a rear shoelace guide 52 is attached to a rear or opposing end 54 of the flex portion. The rear shoelace guide 52 has a U-shape and is connected at spaced ends 56 to the flex portion 24 by stitching. The opposing end or U-shaped portion 58 of the rear shoelace guide 52 is not fixedly attached to the upper 12 so that the opposing end 58 can be lifted upwardly away from the flex portion 24 to allow the shoelace or shoelaces 38 to be inserted through an opening 60 defined by the rear shoelace guide 52. The U-shaped portion 58 of the rear shoelace guide 52 includes a loop and hook-type connector 60 such as Velcro® that secures the U-shaped portion 58 to the flex portion 24. One or more shoelaces 38 are inserted through the front shoelace guide 48, each of the loops 46 formed by the shoelace straps 42, the eyelets 36 on the quarter pieces 28 and the opening 62 of the rear shoelace guide 52 in a criss-cross pattern. The shoelaces 38 are tightened by simply pulling on the ends of the shoelaces and then locking the shoelaces in position using a tightener 64. The tightener 64 includes a release button 66 which enables a user to move the tightener upwardly and downwardly along the shoelaces to respectively tighten and loosen the shoelaces 38 relative to the upper 12.

A lower portion 68 of each quarter piece 28 extends from a bottom end 70 of one of the quarter pieces around the heel portion 18 to the bottom end 70 of the opposing quarter piece as shown in FIG. 1. The stretchable material of the flex portion 24 that extends along the sides 20 of the shoe also extends around the periphery of the heel portion 18. Next to the flex portion 24 is a non-stretchable material section 72 that extends from generally the middle of the heel portion 18 to a foot entry opening 74. Cross-stitching or other suitable stitching is used to connect the stretchable and non-stretchable materials together at the heel portion 18.

Figure 4:
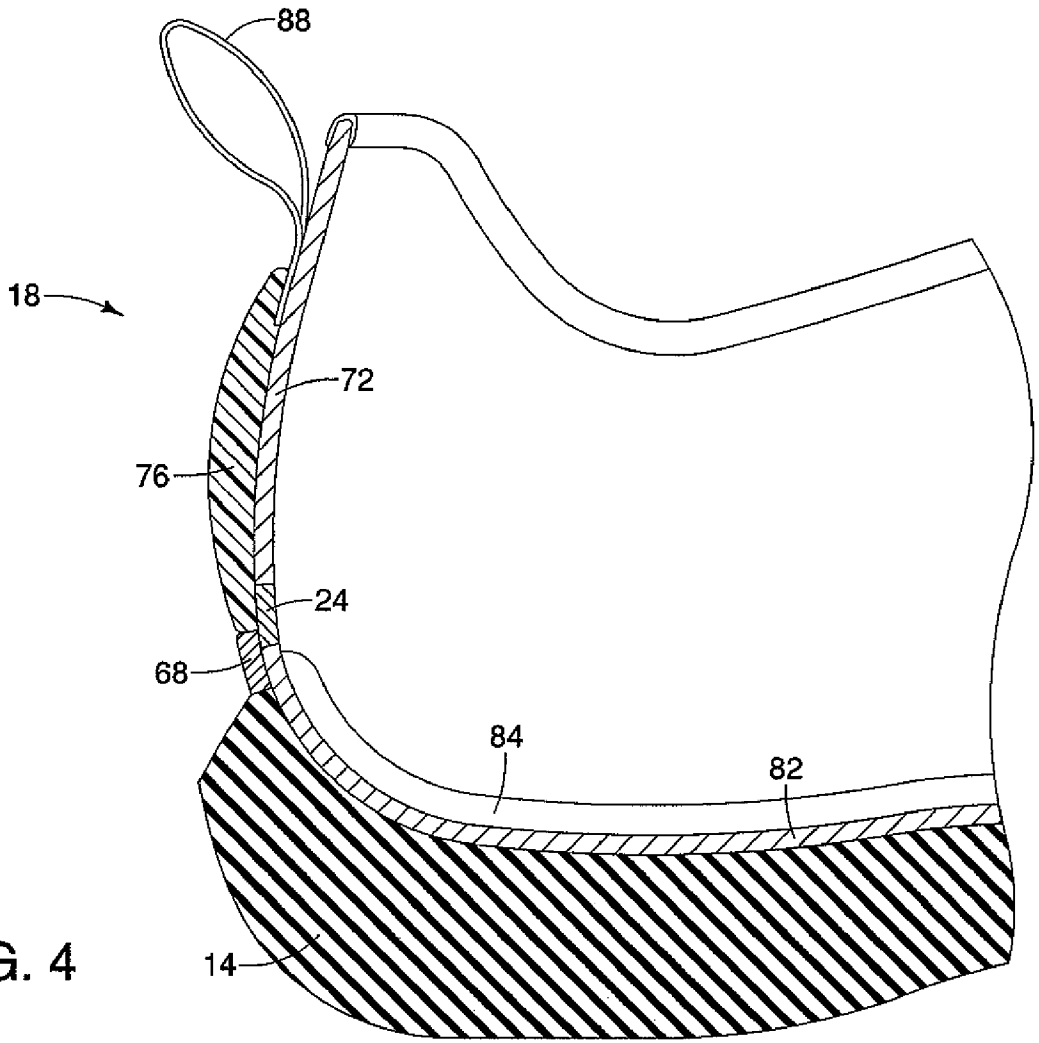
FIG. 4 is a fragmentary cross-section view of the heel portion taken substantially along line 4-4 in FIG. 1.
Figure 5:
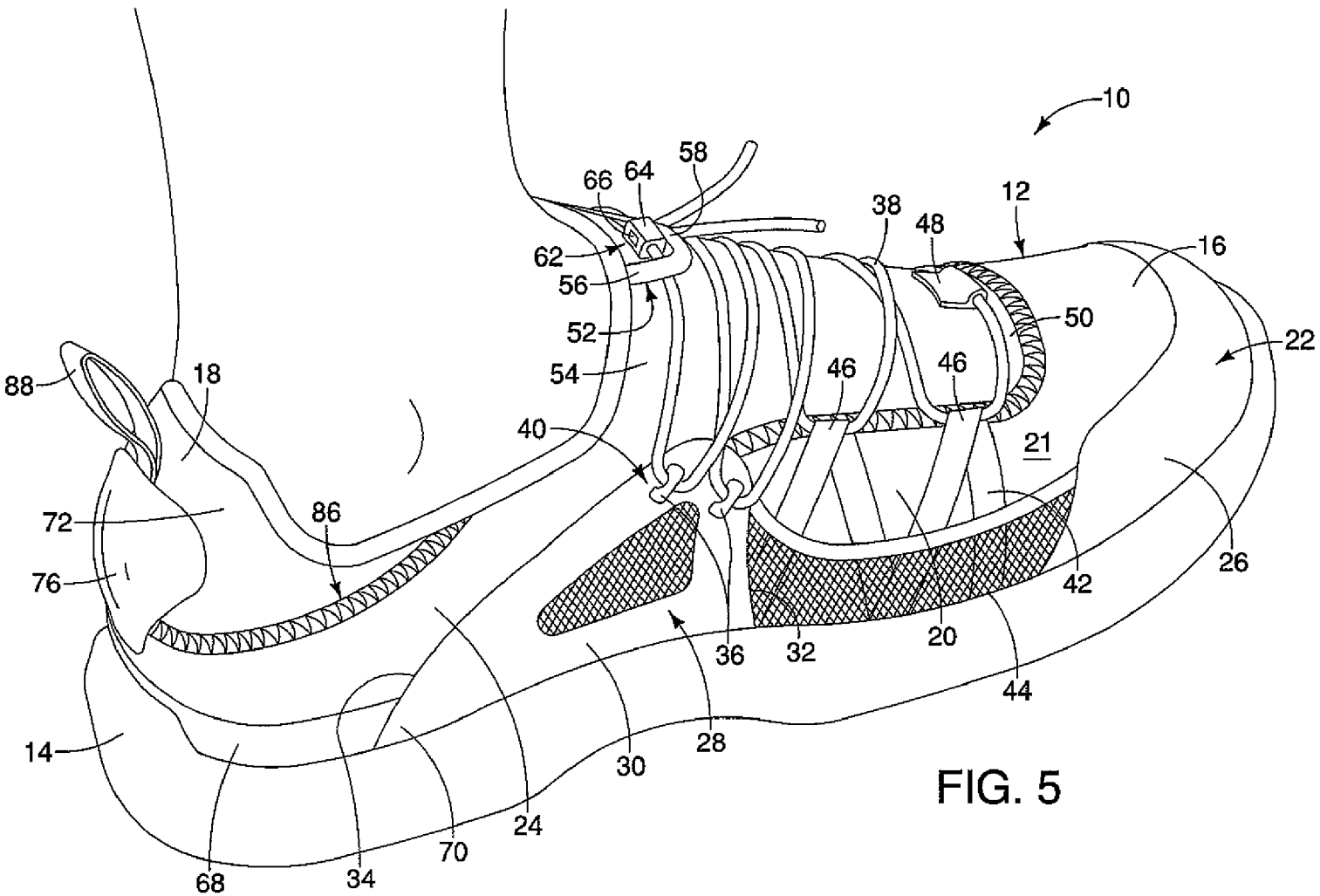
FIG. 5 is a rear perspective view of the article of footwear of FIG. 1 where a user's foot is inserted into the article of footwear with the heel portion in the support position.
Figure 6:
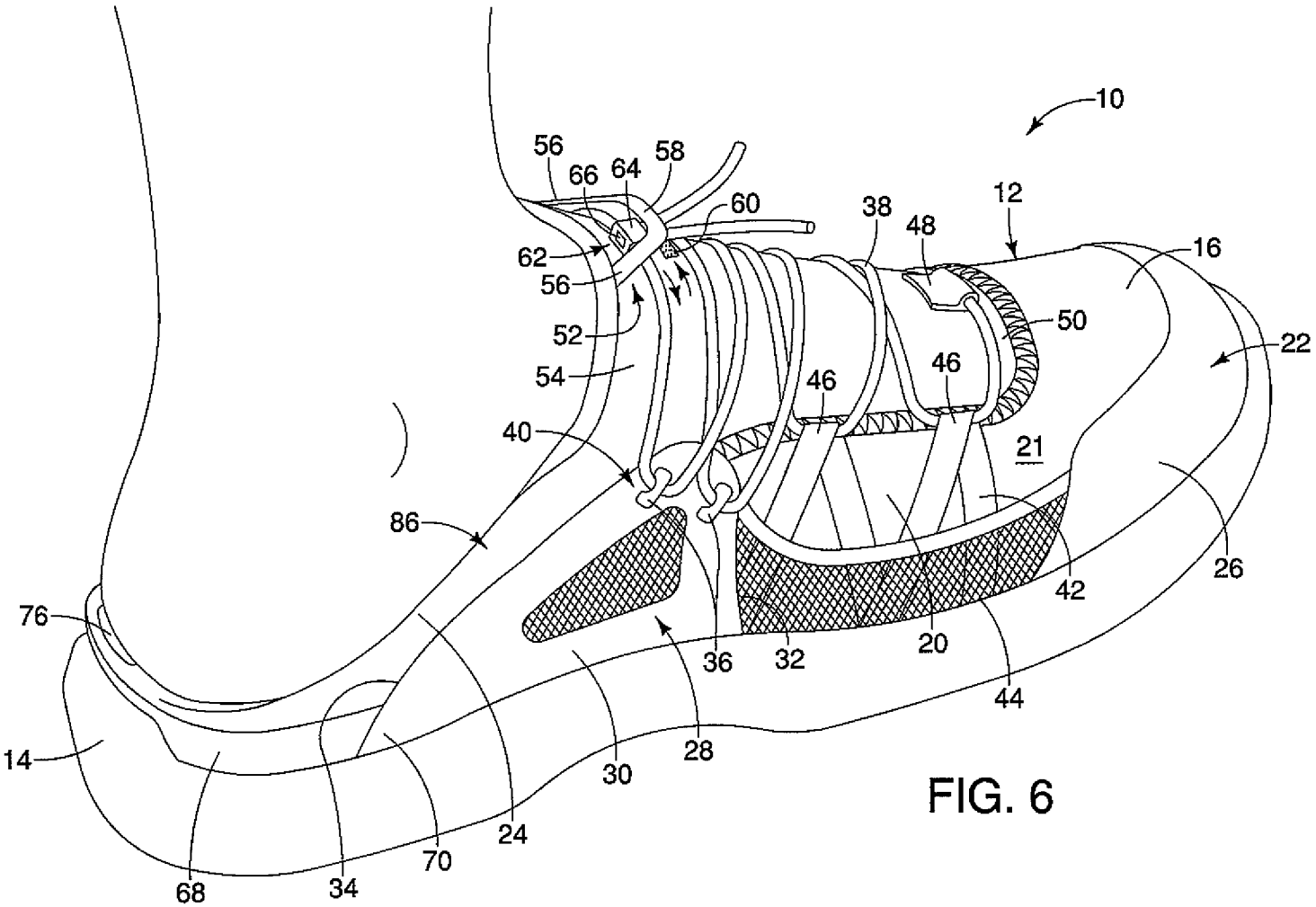
FIG. 6 is a rear perspective view of the article of footwear of FIG. 1 where a user's foot is inserted into the article of footwear with the heel portion in the mule position.

Referring now to FIGS. 1-4, a cushioning heel pad 76 is attached to the heel portion 18 by stitching and extends from a point below the foot entry opening 74 to the quarter piece 28. The cushioning heel pad 76 has a pillow shape with a designated thickness for providing support and comfort to a user's foot as described below. Preferably, the designated thickness of the heel pad 76 is greater than a thickness of the heel portion 18 as best shown in FIG. 4. It is contemplated that the heel pad 76 may have any suitable thickness for cushioning and supporting a user's heel. The cushioning heel pad 76 may be molded or formed from a single material such as a cold press, compression molded Ethylene Vinyl Acetate (EVA), and have a designated thickness or be formed from a combination of materials where at least one of the materials is a cushion-type material such as a foam, EVA or rubber. The heel pad 76 is stitched to the heel portion 18 and helps to hold the abutting ends of the upper 12 together. In the illustrated embodiment, the heel pad 76 extends from a point below the foot entry opening 74 to the quarter piece 28. In another embodiment, the heel pad 76 extends from the foot entry opening 74 to the outsole 14.

A liner 78 made of a flexible or stretchable material is stitched on an inner surface 80 of the upper 12 and extends from the foot entry opening 74 to a strobel 82 connected by stitching to the outsole. The liner 78 is preferably made of a generally stretchable material such as a thin neoprene foam but may be any suitable material. The shoe 10 also includes a removable footbed 84 that is positioned on top of the strobel 82 and has a size and shape conforming to a size and shape of the internal portion of the shoe.

Figure 2:
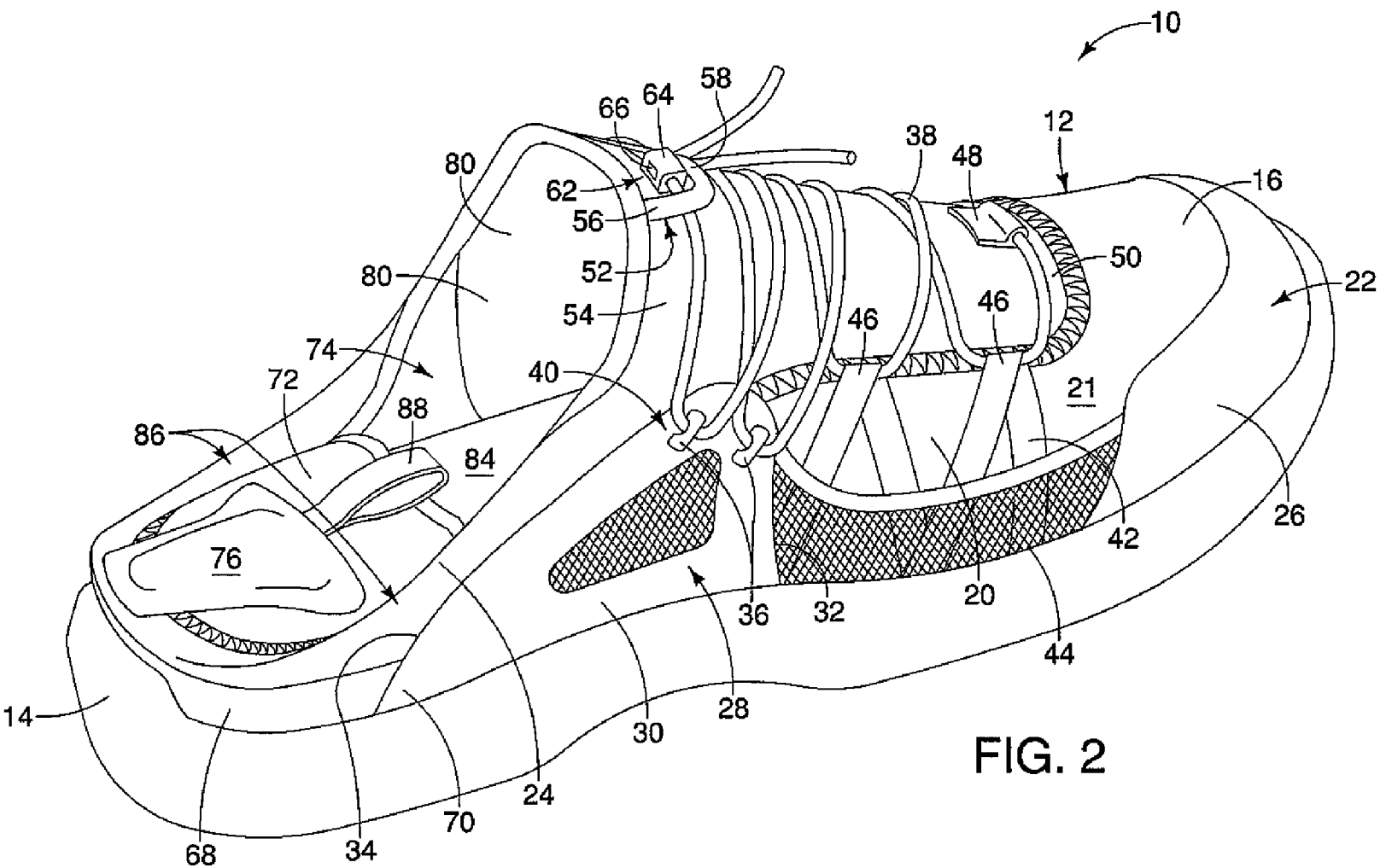
FIG. 2 is a rear perspective view of the article of footwear of FIG. 1 with the heel portion in the mule position.

Referring to FIGS. 1 and 2, the positioning of the non-stretchable material portion 21 next to or adjacent to the flex portion 24 on each side of the heel portion 18 forms flexible areas, flexible lines or bending zones 86 that enable the heel portion 18 to be folded inwardly toward the footbed 84. Specifically, when the heel portion 18 is folded inwardly, the opposing sides of the heel portion fold along the respective flexible area or bending zone 86 between the non-stretchable portion 21 and flexible portion 24. Thus, the heel portion 18 can be folded inwardly and downwardly onto the footbed 84 as best shown in FIG. 3 to form a mule shoe. In this position, the cushioning heel pad 76 on the outer surface of the heel portion 18 now forms part of the footbed 84 such that when a user's foot is inserted into the foot entry opening 74, it contacts and rests on top of the heel pad.

As stated above, the cushioning heel pad 76 is formed or molded to have a designated thickness to act as a cushion for providing enhanced comfort and support for a user's heel when they are wearing the present shoe as a mule. It is contemplated that the size and shape of the cushioning heel pad 76 may be changed to accommodate different sizes of feet and to provide more comfort and support to a user's heel such as to the rear and sides of the heel. The heel pad 76 may also extend from the foot entry opening 74 down to the quarter piece 28 or be any other suitable size to adjust the cushioning and support provided by the heel pad.

To raise and move the heel portion 18 from the mule position (FIG. 2) to the upright or support position (FIG. 1), a user grabs a loop 88 attached to the heel portion 18 and pulls upwardly and rearwardly on the loop. This pulling motion causes the heel portion 18 to move upwardly and outwardly away from the footbed 84 and back to the support position.

As described in the above embodiments, the cushioning heel pad 76 of the present shoe 10 provides a significant amount of cushioning, comfort and support for a user's heel when a user is wearing the shoe as a mule. It should be appreciated that the present shoe 10 may include one or more cushioning heel pads 76. It should also be appreciated that the heel pad 76 may be any suitable size or shape and can be made with any suitable thickness to enhance the cushioning, comfort and support provided by the heel pad on a user's foot.

While a particular embodiment of the present article of footwear has been described herein, it will be appreciated by those skilled in the art that changes and modifications may be made thereto without departing from the invention in its broader aspects.

What is claimed is:

1. An article of footwear comprising:

an outsole;

an upper attached to the outsole;

a heel portion attached to the outsole and movably connected to said upper, said heel portion being movable between a support position where said heel portion is substantially transverse to said outsole, and a mule position where said heel portion is substantially parallel to said outsole; and a cushioning heel pad attached to an outer surface of said heel portion, wherein said heel pad has a designated thickness and contacts and supports a user's heel when said heel portion is in said mule position.

2. The article of footwear of claim 1, wherein said designated thickness of said heel pad is greater than a thickness of said heel portion.

3. The article of footwear of claim 1, wherein said heel pad includes a layer of foam material.

4. The article of footwear of claim 1, wherein said heel pad includes a plurality of layers of material, at least one of said layers including a foam layer.

5. The article of footwear of claim 1, wherein said heel pad extends from a top edge of said upper to said outsole.

6. The article of footwear of claim 1, further comprising a quarter piece attached to said upper.

7. The article of footwear of claim 6, wherein said quarter piece extends from a first side to an opposing second side of said upper.

8. The article of footwear of claim 1, wherein at least part of said heel portion includes a stretchable material defining a flexible area that facilitates folding of said heel portion.

9. The article of footwear of claim 1, wherein said heel pad is made from a cold press, compression molded EVA.

10. An article of footwear comprising:

an outsole;

a footbed placed on an upper surface of said outsole;

an upper attached to the outsole and enclosing said footbed, said upper defining a foot entry opening and including a heel portion that is movable between a support position where said heel portion is substantially transverse to said footbed and supports a back portion of a user's heel, and a mule position where said heel portion is substantially parallel to said footbed; and a pillow-shaped heel pad attached to an outer surface of said heel portion, wherein a user's heel contacts and is supported by said heel pad when the user's foot presses against said outer surface of said heel portion and moves said heel portion to said mule position.

11. The article of footwear of claim 10, wherein said heel pad is integrally molded.

12. The article of footwear of claim 10, wherein said footbed and said heel pad are made of different materials.

13. The article of footwear of claim 10, wherein said heel pad has a thickness that is greater than a thickness of said heel portion.

14. The article of footwear of claim 10, wherein said heel portion includes at least one flexible area for facilitating bending of said heel portion as said heel portion is moved downwardly toward said footbed.

15. The article of footwear of claim 10, wherein said heel pad extends from said foot entry opening to said outsole.

16. The article of footwear of claim 1, further comprising a quarter piece attached to a first side and a second side of said upper.

17. The article of footwear of claim 16, further comprising an additional quarter piece that extends from said first side to said second side of said upper.

* * * * *